US010925791B2

(12) United States Patent
Chandan et al.

(10) Patent No.: US 10,925,791 B2
(45) Date of Patent: Feb. 23, 2021

(54) PATIENT LIFT SYSTEM

(71) Applicant: Amico Mobility Solutions Corp., Richmond Hill (CA)

(72) Inventors: Varun Chandan, Caledon (CA); Wayne Benson, Newmarket (CA); Mark P. Chepurny, Bradford (CA)

(73) Assignee: Amico Mobility Solutions Corp., Richmond Hill (CA)

( * ) Notice: Subject to any disclaimer, the term of this patent is extended or adjusted under 35 U.S.C. 154(b) by 0 days.

(21) Appl. No.: 16/733,976

(22) Filed: Jan. 3, 2020

(65) Prior Publication Data

US 2020/0138657 A1 May 7, 2020

Related U.S. Application Data

(63) Continuation of application No. 15/766,257, filed as application No. PCT/CA2016/050847 on Jul. 18, 2016, now Pat. No. 10,555,856.

(60) Provisional application No. 62/308,316, filed on Mar. 15, 2016, provisional application No. 62/237,199, filed on Oct. 5, 2015.

(51) Int. Cl.
*A61G 7/10* (2006.01)
*G08B 5/36* (2006.01)

(52) U.S. Cl.
CPC ..... *A61G 7/1042* (2013.01); *A61G 7/1015* (2013.01); *A61G 7/1061* (2013.01); *G08B 5/36* (2013.01); *A61G 2203/12* (2013.01); *A61G 2203/30* (2013.01)

(58) Field of Classification Search
CPC .. A61G 7/1042; A61G 7/1015; A61G 7/1061; A61G 2203/12; G08B 5/36
See application file for complete search history.

(56) References Cited

U.S. PATENT DOCUMENTS 3,628,588 A * 12/1971 Dixon ..... E05D 15/0652 160/40
D553,825 S * 10/2007 Shani ..... D34/33
(Continued)

FOREIGN PATENT DOCUMENTS

DE 9109343 U1 11/1991
EP 2254539 B1 12/2010
(Continued)

OTHER PUBLICATIONS

Extended European Search Report; EP 16852929.5; dated Mar. 28, 2019.

(Continued)

*Primary Examiner* — Jason C Smith
(74) *Attorney, Agent, or Firm* — Ridout & Maybee LLP

(57) ABSTRACT

A patient lift system helps to lift and mobilize a disabled person in a home or in an institution with minimal effort from a caregiver. The patient lift system includes a lift, a carry bar and a hand control. The lift, the carry bar and the hand control have shapes and features that may be seen to facilitate quick and easy cleaning. Notably, gaps have been minimized for infection control purposes. Typically, a patient lift system includes an integral trolley for connecting the patient lift system to a track. For the patient lift system described herein, the trolley and lift system are separate pieces that are easily and quickly either attached or detached.

18 Claims, 8 Drawing Sheets

(56) References Cited

U.S. PATENT DOCUMENTS

D566,375 S * 4/2008 Shani ..... D34/33
D567,472 S * 4/2008 Shani ..... D34/33
2005/0115914 A1* 6/2005 Chepurny ..... A61G 7/1015 212/328
2007/0274817 A1* 11/2007 Chepurny ..... A61G 7/1042 414/749.1
2009/0308828 A1* 12/2009 Hansen ..... A61G 7/1042 212/320
2010/0043140 A1* 2/2010 Chepurny ..... A61G 7/1015 5/85.1
2010/0270252 A1* 10/2010 Chepurny ..... A61G 7/1015 212/76
2010/0288155 A1* 11/2010 Chepurny ..... A61G 7/1042 104/89
2012/0000876 A1* 1/2012 Bergenstrale ..... A61G 7/1042 212/336
2012/0011650 A1* 1/2012 Chepurny ..... A61G 7/1015 5/85.1
2012/0018689 A1* 1/2012 Chepurny ..... A61G 7/1015 254/342
2012/0291197 A1* 11/2012 Martin ..... A61G 7/1019 5/85.1
2013/0019401 A1* 1/2013 Faucher ..... A61G 7/1015 5/85.1
2013/0031031 A1* 1/2013 Gordon ..... A61G 7/1015 705/500
2014/0075669 A1* 3/2014 Andersson ..... A61G 7/1015 5/85.1
2014/0115778 A1* 5/2014 Ng ..... A61G 7/1015 5/83.1
2014/0131301 A1* 5/2014 Newkirk ..... A61G 7/10 212/324
2014/0201905 A1* 7/2014 Glukhovsky ..... A61G 7/1049 5/81.1 R
2014/0223661 A1* 8/2014 Galloway ..... A61G 7/1042 5/85.1
2014/0259392 A1* 9/2014 Chen ..... A61G 7/1042 5/85.1
2015/0107020 A1* 4/2015 Andersson ..... A61G 7/108 5/83.1
2015/0216753 A1* 8/2015 Arespong ..... A61G 7/1013 5/83.1
2015/0320632 A1* 11/2015 Vallery ..... A61H 3/008 482/69
2015/0321031 A1* 11/2015 Monn ..... A61G 7/1042 182/3
2017/0027796 A1* 2/2017 Kaikenger ..... A61G 7/1015
2017/0354559 A1* 12/2017 Brulotte ..... A45F 3/22
2017/0354560 A1* 12/2017 Brulotte ..... A61G 7/1051
2017/0360635 A1* 12/2017 Brulotte ..... A61G 7/1015
2017/0360637 A1* 12/2017 Brulotte ..... A61G 7/1015
2018/0028384 A1* 2/2018 Benoit ..... A61G 7/1042
2018/0153754 A1* 6/2018 Bolin ..... A61G 7/1042
2018/0207042 A1* 7/2018 Ringbjer ..... A61G 7/1055
2018/0228679 A1* 8/2018 Seibt ..... A61G 7/1007
2018/0280221 A1* 10/2018 Chandan ..... A61G 7/1015

FOREIGN PATENT DOCUMENTS

EP 2671557 A1 12/2013
WO 2009155930 A1 12/2009

OTHER PUBLICATIONS

Extended European Search Report; EP 20172380.6; dated Jul. 1, 2020.

* cited by examiner

PATIENT LIFT SYSTEM

FIELD

The present application relates generally to hospital equipment and, more specifically, to a patient lift system.

BACKGROUND

Patient lift systems are known. For example, companies such as V. Guldmann A/S of Arhus, Danmark, Prism Medical Canada of Concord, Canada, the ArjoHuntleigh portion of the Getinge Group AB of Getinge, Sweden, the Liko portion of Hill-Rom, Inc. of Batesville, Ind., and Tollos, Inc. of Barrie, Canada are known to manufacture and distribute patient lift systems.

The known patient lift systems are typically designed to be attached to a track fastened to the ceiling of a room. Once installed, the patient lift system is suspended from the track. The track may be seen to provide a range of possible locations. The track may also provide the patient lift system with electrical power.

Unfortunately, the size of the known patient lift systems may be seen to be too large, especially for a small room or a room with a low ceiling. Similarly, the shape of known lift systems might be considered to be ungainly.

BRIEF DESCRIPTION OF THE DRAWINGS

Reference will now be made, by way of example, to the accompanying drawings which show example implementations; and in which.

DETAILED DESCRIPTION

A patient lift system described herein may be seen to help lift and mobilize a disabled person in a home or in an institution with minimal effort from a caregiver. The patient lift system includes a lift, a carry bar and a hand control. The lift, the carry bar and the hand control have shapes and features that may be seen to facilitate quick and easy cleaning. Notably, gaps have been minimized for infection control purposes. Typically, a patient lift system includes an integral trolley for connecting the patient lift system to a track. For the patient lift system described herein, the trolley and lift system are separate pieces that are easily and quickly either attached or detached.

According to an aspect of the present disclosure, there is provided a patient lift system for connecting to a track. The system includes a trolley arranged to form a mechanical and electrical connection to the track. The system further includes a lift unit chassis operable to form an electrical connection and a mechanical connection with the trolley, the chassis enclosing: a strap hub; a hub gear attached to the strap hub; a plurality of gear shafts; a plurality of gears; and a plurality of motors, each motor of the plurality of motors arranged to drive a respective gear shaft among the plurality of gear shafts, each gear shaft of the plurality of gear shafts connected to a respective gear among the plurality of gears, the plurality of gears arranged such that the hub gear rotates responsive to rotation of the gear shafts by the motors. The system further includes a strap extending external to the lift unit chassis, attached, at a first end, to the strap hub and attached, at a second end, to a connector and a carry bar connected to the connector, wherein the rotation of the hub gear acts to gather or release the strap, thereby raising or lowering the carry bar.

Other aspects and features of the present disclosure will become apparent to those of ordinary skill in the art upon review of the following description of specific implementations of the disclosure in conjunction with the accompanying figures.

Figure 1:
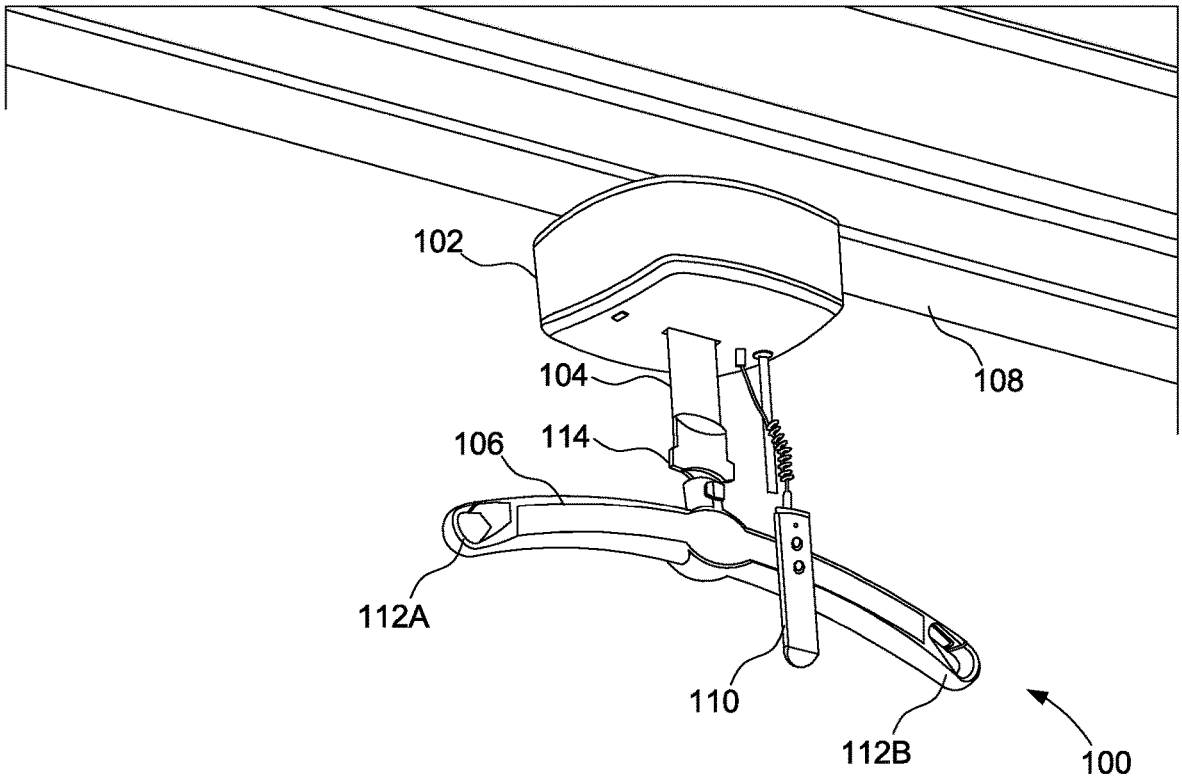
FIG. 1 illustrates, in an underside perspective view, a patient lift system having a lift unit chassis connected to a track.

FIG. 1 illustrates, in an underside perspective view, a patient lift system 100. The patient lift system 100 includes a lift unit chassis 102, a carry bar 106 and a strap 104 connecting the carry bar 106 to the lift unit chassis 102. The strap 104, which may, for example, be formed from polyester, has a connector for releasably connecting the strap 104 to the carry bar 106. Indeed, the connector 114 may include passive disengagement prevention. That is, the connector 114 may be arranged such that, before the carry bar 106 may be disengaged from the connector 114, a user lifts the carry bar 106 to reduce downward forces on the connector 114. The carry bar 106 has, at one end, a first hook 112A and, at the other end, a second hook 112B. The lift unit chassis 102 is held aloft through a connection to a quick release trolley 300 (illustrated in FIG. 3) that is maintained in a track 108. FIG. 1 illustrates a hand control unit 110 dangling from a connection to the lift unit chassis 102.

Figure 2:
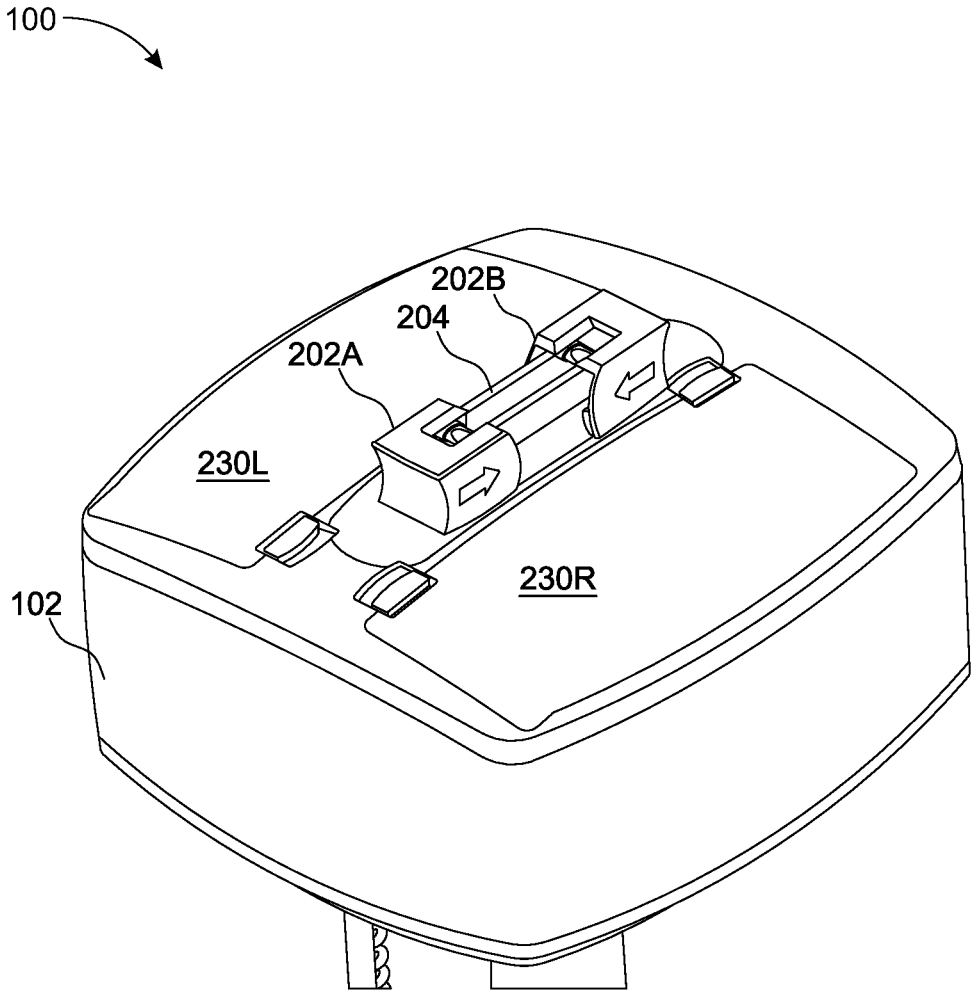
FIG. 2 illustrates, in a topside perspective view, the lift unit chassis of FIG. 1.

FIG. 2 illustrates, in a topside perspective view, the lift unit chassis 102 of FIG. 1. The view of FIG. 2 facilitates review of a quick release system that allows connection of the lift unit chassis 102 to the quick release trolley 300. The quick release system includes a first quick release trolley button 202A and a second quick release trolley button 202B, which may, for example, be formed of plastic. The first quick release trolley button 202A and the second quick release trolley button 202B are positioned at either end of a quick release trolley plate 204. As illustrated in FIG. 2, the quick release trolley plate 204 defines a slot-like aperture that is not specifically associated with a reference numeral. Also illustrated in FIG. 2 are two battery compartment covers 230R, 230L. The battery compartment covers 230R, 230L cover battery compartments in which are housed batteries (not shown) and battery charging circuitry (not shown).

Figure 3:
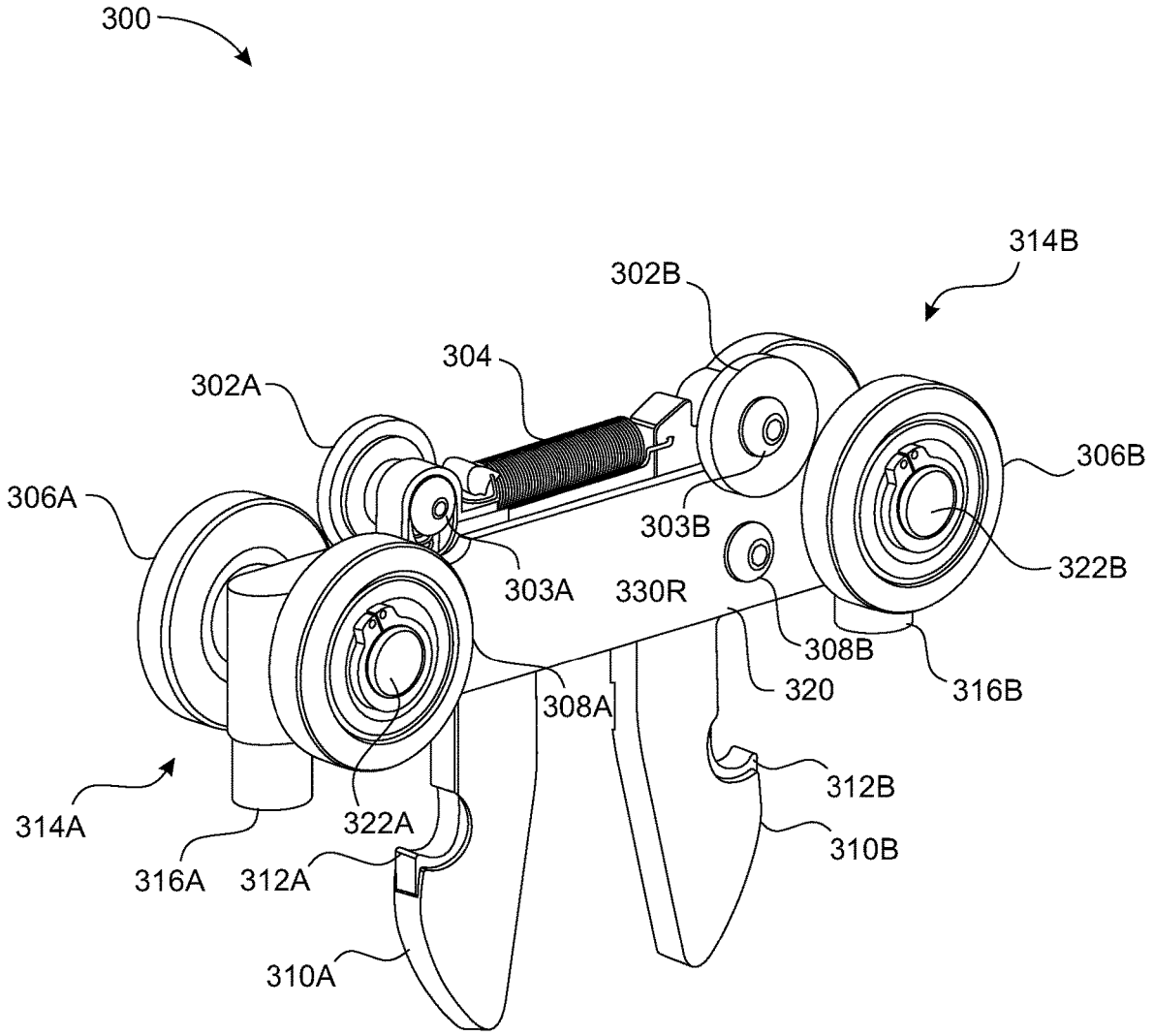
FIG. 3 illustrates a quick release trolley for connecting the lift unit chassis to the track of FIG. 1.
Figure 4:
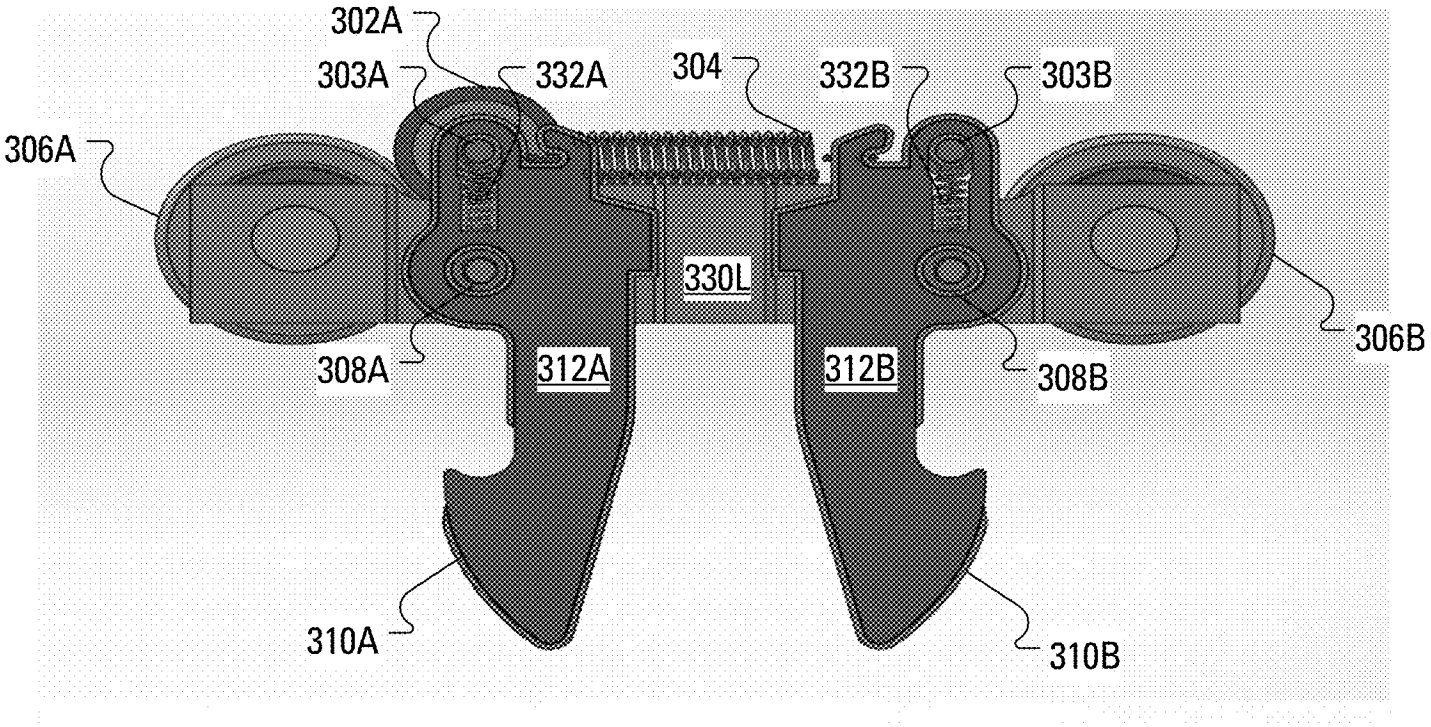
FIG. 4 illustrates the quick release trolley of FIG. 3 in a sectional view.

FIG. 3 illustrates the quick release trolley 300 operable for connecting the lift unit chassis 102 to the track 108. FIG. 4 illustrates the quick release trolley 300 of FIG. 3 in a sectional view. The quick release trolley 300 is based around a trolley block 320 comprising two parallel plates 330R, 330L joined a first end 314A and a second end 314B. The first end 314A of the trolley block 320 carries a first axle 322A, on which a first pair of quick release trolley wheels 306A are rotatably installed. The second end 3146 of the trolley block 320 carries a second axle 322B, on which a second pair of quick release trolley wheels 306B are rotatably installed. The first pair of quick release trolley wheels 306A and the second pair of quick release trolley wheels 306B may, for example, be formed of plastic. The plates 330R, 330L of the trolley block 320 define a first aperture (not shown) in which a first pivot pin 308A is held and a second aperture (not shown) in which a second pivot pin 308B is held. The material for the trolley block 320 may be, for example, aluminum 6061-T6. The first axle 322A and the second axle 322B may be formed of American Iron and Steel Institute/Society of Automotive Engineers (AISI/SAE) 1020 steel.

A first hook-shaped quick release trolley latch 312A is supported by the first pivot pin 308A between the plates 330R, 330L of the trolley block 320. The first quick release trolley latch 312A is sheathed in a first trolley latch cover 310A. Similarly, a second hook-shaped quick release trolley latch 312B is supported by the second pivot pin 308B between the plates 330R, 330L of the trolley block 320. The second quick release trolley latch 312B is in a second trolley latch cover 310B. The first trolley latch cover 310A and the second trolley latch cover 3106 may, for example, be formed of plastic.

A first track guide 316A is positioned under, and attached to, the first end 314A of the trolley block 320. A second track guide 3166 is positioned under, and attached to, the second end 314B of the trolley block 320. The track guides 316, which may, for example, be formed of plastic, assist in maintaining the quick release trolley 300 in position in the track 108. Without the track guides 316, the quick release trolley 300 may be inclined to tilt under transverse forces. In operation, a majority of the quick release trolley 300 is carried within the track 108, with only the quick release trolley latches 312A, 312B extending through a slot-like aperture in the track 108 to engage the quick release trolley plate 204 of the lift unit chassis 102.

As illustrated in FIG. 4, a slot in the first quick release trolley latch 312A that extends out of the top of the trolley block 320 carries a first charging bolt 303A and a first charging bolt biasing member 332A. The first charging bolt biasing member 332A urges the first charging bolt 303A toward an upper end of the slot in the slot in the first quick release trolley latch 312A. A first charging contact 302A is mounted to the first charging bolt 303A.

A slot in the second quick release trolley latch 312B that extends out of the top of the trolley block 320 carries a second charging bolt 303B and a second charging bolt biasing member 332B. The second charging bolt biasing member 332B urges the second charging bolt 303B toward an upper end of the slot in the slot in the second quick release trolley latch 312B. A second charging contact 302B is mounted to the second charging bolt 303B.

The first charging contact 302A and the second charging contact 302B may be formed of AISI/SAE 1020 steel.

The trolley 300 includes a quick release trolley spring (generically, a biasing member) 304 arranged to bias the portion of the first quick release trolley latch 312A that extends out of the top of the trolley block 320 toward the portion of the second quick release trolley latch 3126 that extends out of the top of the trolley block 320. Accordingly, the quick release trolley spring 304 acts to bias the bottom of the first quick release trolley latch 312A away from the bottom of the second quick release trolley latch 312B. The quick release trolley spring 304, the first quick release trolley latch 312A and the second quick release trolley latch 312B may be formed from AISI/SAE 1020 steel.

Figure 5:
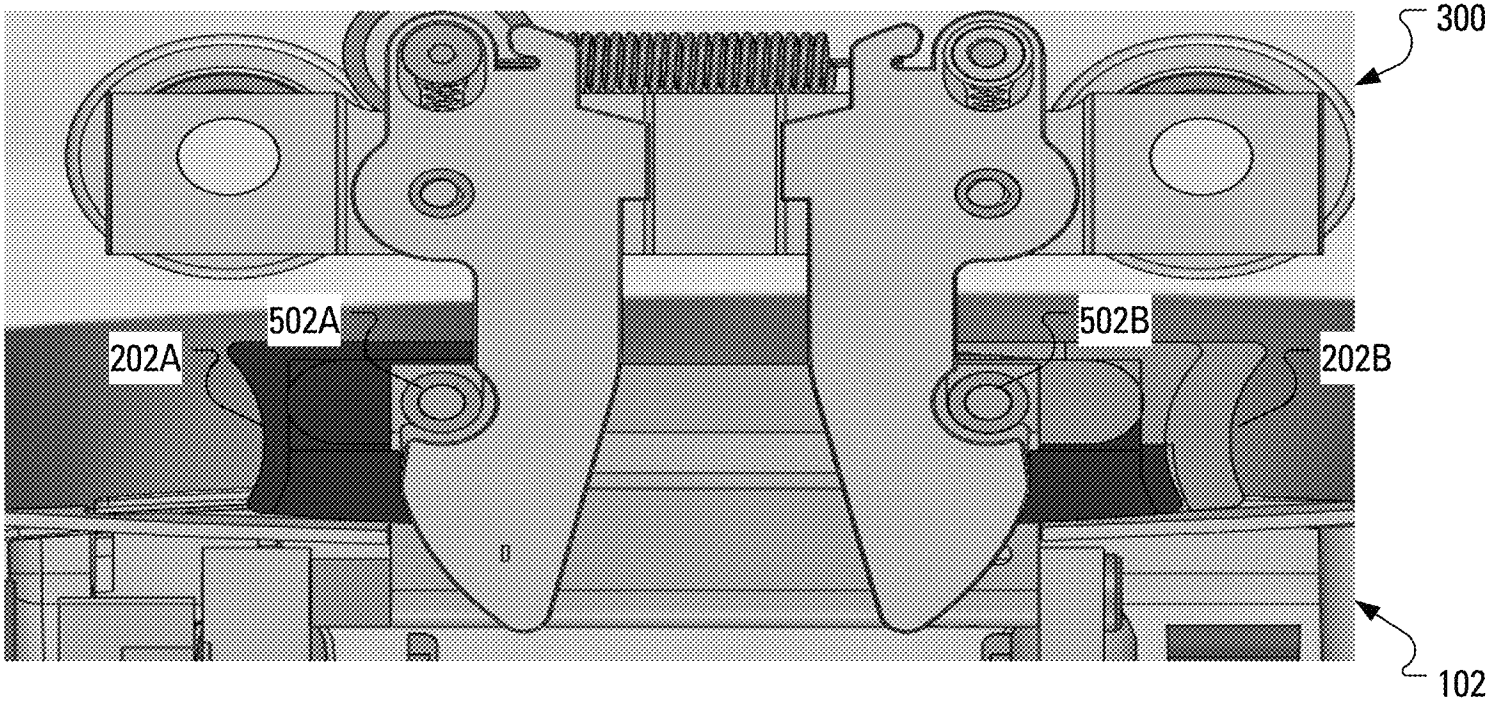
FIG. 5 illustrates, in sectional view, the quick release trolley of FIG. 3 in use connected to the lift unit chassis of FIG. 1.

FIG. 5 illustrates, in sectional view, the trolley 300 in use connected to the lift unit chassis 102. As illustrated in FIG. 5, the first quick release trolley button 202A hides a first latching post 502A and the second quick release trolley button 202B hides a second latching post 502B. The first latching post 502A and the second latching post 502B may, for example, be formed from AISI/SAE 1020 steel. To achieve the connection illustrated in FIG. 5, the lift unit chassis 102 may be manually maneuvered to allow the first quick release trolley latch 312A and the second quick release trolley latch 312B to be received by the slot-like aperture defined by the quick release trolley plate 204. As the quick release trolley latches 312A, 312B are received within the slot, a lower portion of the first quick release trolley latch 312A is urged toward a lower portion of the second quick release trolley latch 3126 by the first latching post 502A. Similarly, as the second quick release trolley latch 312B is received within the slot, the lower portion of the second quick release trolley latch 3126 is urged toward the lower portion of the first quick release trolley latch 312A by the second latching post 502B.

The lift unit chassis 102 may include one or more indicator light emitting diodes (LEDs), which, when illuminated, may be visible outside of the lift unit chassis 102. Responsive to sensors (not shown) within the lift unit chassis 102 determining that the lift unit chassis 102 is installed improperly, notification circuitry (not shown) may control an indicator LED of a particular color (for example, red) to illuminate. Furthermore, the notification circuitry may control an audio alarm, such as a buzzer, as a secondary indicator that the lift unit chassis 102 is installed improperly. The notification circuitry may control the red LED to remain illuminated (and the buzzer to continue to sound) until the sensors determine that the lift unit chassis 102 has been installed properly. Responsive to the sensors determining that the lift unit chassis 102 is installed properly, the notification circuitry may control an indicator LED of another color (for example, green) to illuminate and remain illuminated until the lift unit chassis 102 has been disconnected from the trolley 300.

Figure 6:
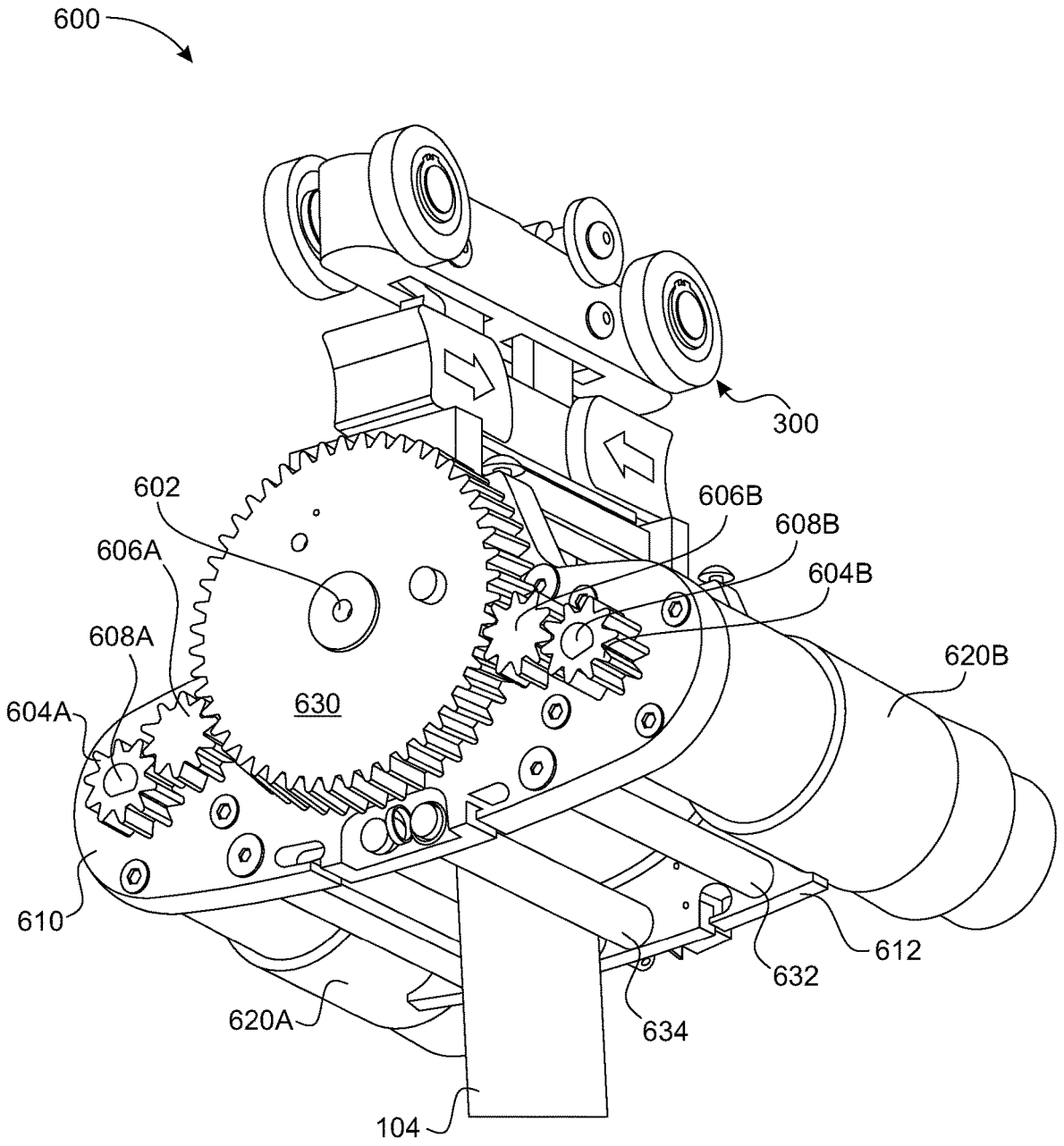
FIG. 6 illustrates, in a right front perspective view, elements of a lift unit internal to the lift unit chassis of FIG. 1.

FIG. 6 illustrates, in a right front perspective view, elements of a lift unit 600 internal to the lift unit chassis 102 of FIG. 1. Central to the lift unit 600 is a strap hub 602 that extends between and beyond a motor mounting plate 610 and a strap hub mounting plate 612. A space is defined between the motor mounting plate 610 and the strap hub mounting plate 612, with the space maintained through the use of a plurality of braces fastened to both the motor mounting plate 610 and the strap hub mounting plate 612. Two example braces are associated with reference numerals 632 and 634.

A first lift motor 620A and a second lift motor 620B are fastened to the motor mounting plate 610. The first lift motor 620A connects to a first motor shaft 608A. Similarly, the second lift motor 620B connects to a second motor shaft 608B. The first lift motor 620A may include a spindle lock for preventing the first lift motor 620A from back driving. Similarly, the second lift motor 620B may include a spindle lock for preventing the second lift motor 620B from back driving. Fastened to the strap hub 602, outside of the space, is a hub gear 630. Teeth of a first motor gear 604A, mounted to the first motor shaft 608A, are positioned to mesh with teeth of a first idler gear 606A. Teeth of the first idler gear 606A are positioned to mesh with teeth of the hub gear 630.

Teeth of a second motor gear 604B, mounted to the second motor shaft 6086, are positioned to mesh with teeth of a second idler gear 606B. The strap hub 602, the first idler gear 606A, the second idler gear 606B, the first motor shaft 608A and the second motor shaft 608B may, for example, be formed from AISI/SAE 1020 steel.

Figure 7:
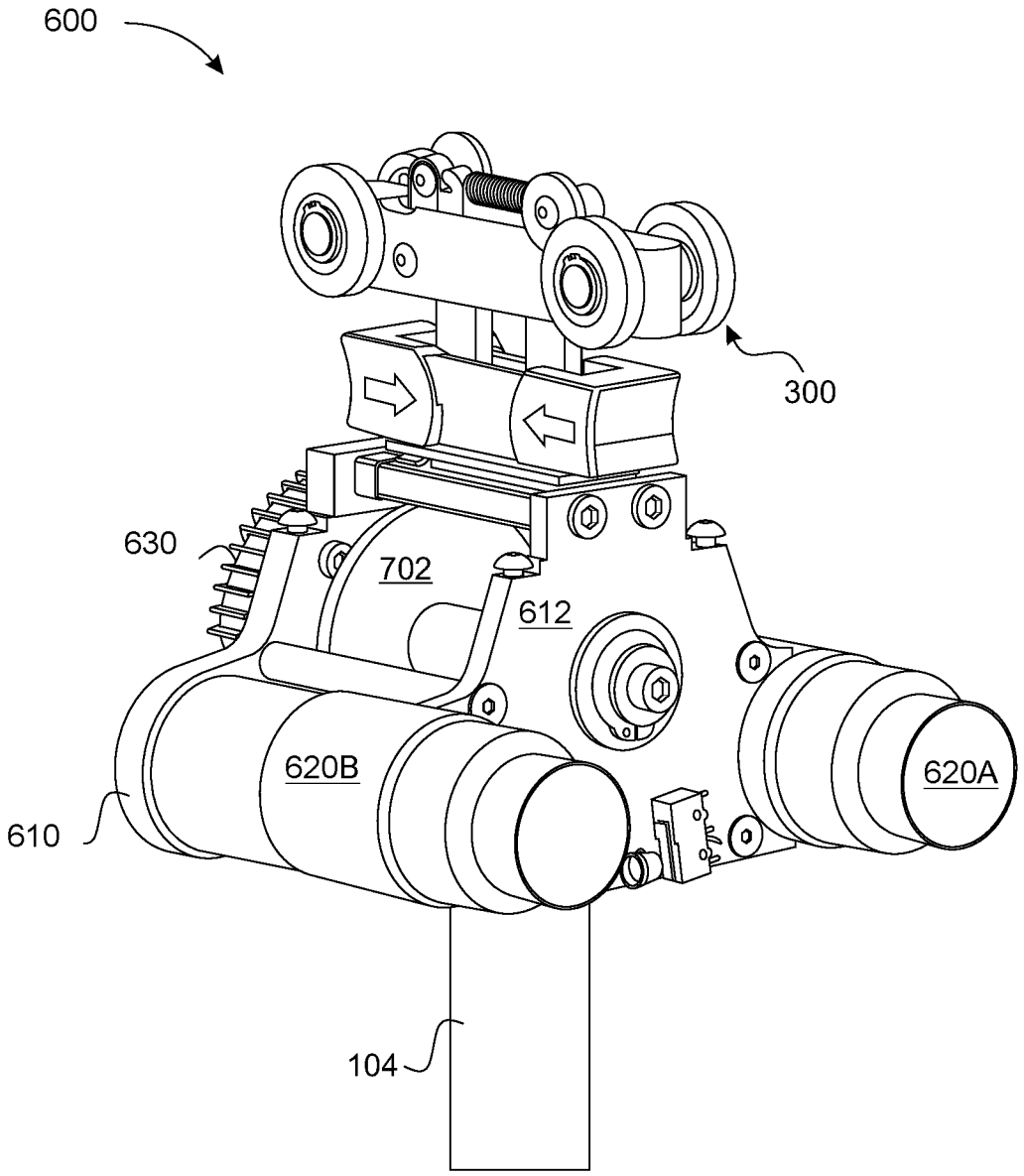
FIG. 7 illustrates, in a right rear perspective view, elements of the lift unit of FIG. 6.

FIG. 7 illustrates, in a right rear perspective view, elements of the lift unit 600 of FIG. 6. Included among elements of the lift unit 600 that are not visible in the view of FIG. 6 are a strap guard 702 mounted to the strap hub 602.

In overview, the patient lift system 100 may be seen to help lift and mobilize a disabled person with minimal effort from a caregiver.

In one aspect of the present application, the lift motors 620A, 620B are direct current (DC) motors that are powered by the batteries that are hidden by the battery compartment covers 230R, 230L. An alternating current (AC) electrical circuit may be formed as the first charging contact 302A contacts a first charge point (not shown) within the track and the second charging contact 302B contacts a second charge point (not shown) also within the track.

Via the first charging bolt 303A, the current received by the first charging contact 302A may be transferred to the first quick release trolley latch 312A and from the first quick release trolley latch 312A to the first latching post 502A. The current may then flow from the first latching post 502A to the second latching post 502B through battery charging circuitry (not shown) within the lift unit chassis 102. From the second latching post 502B, the circuit is completed through the second quick release trolley latch 312B, the second charging bolt 303B and the second charging contact 302B. It should be appreciated that the design of the battery charging circuitry is fairly routine and may include relays, integrated circuits, resistors and other electronic components.

In operation, the caregiver may employ the hand control unit 110 to control the patient lift system 100 to cause the first lift motor 620A and the second lift motor 620B to rotate their respective motor shafts 608A, 608B. Indeed, signals from the hand control unit 110 may be received, within the lift unit chassis 102, at control circuitry (not shown). Responsive to receiving the signals, the control circuitry may control flow of current from the batteries to the first lift motor 620A and the second lift motor 620B. The rotation of the first motor shaft 608A effects rotation of the first motor gear 604A, which effects rotation of the first idler gear 606A. Similarly, the rotation of the second motor shaft 608B effects rotation of the second motor gear 604B, which effects rotation of the second idler gear 606B. The rotation of the first idler gear 606A and the second idler gear 606B causes rotation of the hub gear 630, which causes rotation of the strap hub 602 in a manner that, in one direction, allows the strap 104 to spool out of the lift unit chassis 102, thereby lowering the carry bar 106. The rotation of the first idler gear 606A and the second idler gear 606B causes rotation of the hub gear 630, which causes rotation of the strap hub 602 in a manner that, in the other direction, allows the strap 104 to spool up into the lift unit chassis 102, thereby raising the carry bar 106.

With the carry bar 106 lowered, the care giver may connect a first end of a sling (not shown) to the first hook 112A of the carry bar 106 and may connect a second end of the sling to the second hook 1126 of the carry bar 106. The caregiver may then position the sling under the patient to be moved. Once the sling has been appropriately positioned, the caregiver may, through appropriate actuation of one or more buttons on the hand control unit 110, control the patient lift system 100 so that the first lift motor 620A and the second lift motor 620B rotate their respective motor shafts 608A, 608B to, indirectly, cause rotation of the strap hub 602 in a manner that, in one direction, allows the strap 104 to spool up, into the lift unit chassis 102, thereby raising the carry bar 106 and the patient in the sling.

The patient lift system 100 of FIG. 1 is dramatically smaller in size than current competitors (small size=>7.86" long, 7.82" wide, 4.29" thick). By reducing the size, a user gains degrees of vertical travel important in an area with a relatively low ceiling. Furthermore, the user may find improved horizontal travel (over competing devices), which is important in small rooms where beds and other furniture will be against walls. Even further, the reduced size facilitates easier storage at a manufactures warehousing facility and in a hospital's central equipment area. The reduced size also reduces shipping costs and makes installation and maintenance easier. The small size also allows the fitting of multiple lifts in the same amount of space that would fit a single lift of known size and shape. Two lifts may facilitate the lifting of a patient weighing over 1000 lbs.

The relatively small size of the patient lift system 100 is facilitated through the selection of small powerful motors for the first lift motor 620A and the second lift motor 620B. Furthermore, the patient lift system 100 may be considered to have been enhanced relative to competitive devices through the use of efficient metal gearing to reduce power loss through internal friction. Indeed, spur gears with high strength bushing or bearings may be used for the hub gear 630, the first idler gear 606A, the second idler gear 606B, the first motor gear 604A and the second motor gear 604B. Consequently, deflection may be minimized while reducing rotational resistance.

A value representative of efficiency is current draw. It may be illustrated that the patient lift 100 may draw only 12 Amps for a task that may cause a competitive system to draw 20 Amps or more.

In addition, the overall shape is designed for aesthetic appeal. Furthermore, the overall shape is designed for seamlessness, which may be seen to address infection control concerns. Conveniently, the lift unit chassis 102, the carry bar 106 and the hand control unit 110 have been designed to have shapes and features that may be seen to facilitate quick and easy cleaning. Furthermore, gaps have been minimized for infection control purposes.

Moreover, the patient lift system 100 may include a sterile strap cover (not shown) to fit the exposed length of the strap 104 to provide protection against infection. This strap cover (not shown) may be mounted, on one end, to a carry bar attachment mechanism on the carry bar 106 and, on the other end, to a lift unit chassis attachment mechanism on the lift unit chassis 102. Conveniently, minimal effort from user is required to install such a strap cover. The strap cover may be disposable or may be configured for easy sterilization.

The hand control unit 110 is also designed with infection control in mind. In order to provide a seamless hand control unit 110, the hand control unit 110 is designed with touch sensitive controls that have no seams and, thereby, facilitate cleaning. The touch sensitive controls are designed to allow for operation by a user wearing gloves, a user wearing no gloves or through other plastic covers around the hand control unit 110. By designing features that take into account infection control, the patient lift system 100 could be installed in areas where sterilization and infection control is a major concern, e.g., in an operating room. Furthermore, the touch sensitive controls allow caregivers with limited dexterity to operate the patient lift system 100 with ease.

Another feature allows for hospital administration to manage lift stock by installing track all around the hospital, while utilizing only a few lifts at any given point. Such ease of management is facilitated by the quick release trolley system. The quick release trolley system is designed with a multiple hook system that allow for a connection to be formed between the trolley 300 and the lift unit chassis 102. The trolley 300 is designed such that the installation of the lift unit chassis 102 to the trolley 300 is a one hand operation. The connection to be formed between the trolley 300 and the lift unit chassis 102 provides both a mechanical connection and an electrical connection. A visual and/or audio confirmation may provide, to a user, feedback for confirmation of correct installation. Indeed, for audio confirmation of correct installation, one or more tones may be generated. Upon detection of an incorrect installation, an audio buzzer may be activated to alert the user. For visual confirmation, the lift unit chassis 102 may be equipped with multiple light emitting diodes (LEDs) whose illumination may be visible outside of the lift unit chassis 102. Upon detecting that the patient lift system 100 is not installed correctly, circuitry within the lift unit chassis 102 may arrange the illumination of a red LED. The red LED may remain illuminated until the patient lift system 100 is installed properly. To prevent accidental disengagement, the patient lift system 100 employs a passive locking system, which is designed such that the user must apply force to the lift unit chassis 102, e.g., lift the lift unit chassis 102 and press the quick release trolley buttons 202A, 202B toward each other to disengage the lift unit chassis 102 from the trolley 300. The quick release latches 312A, 312B are designed to ensure they do not move unless and until is lifted upwards to remove load from the quick release latches 312A, 312B before being able to press the quick release latches 312A, 312B inwards to disengage.

Moreover, in areas where there is possibility of a patient with a weight that surpasses a weight limit, the track can be outfitted with multiple trolleys but without the lift unit chassis 102. When there is need for lifting a particularly heavy patient, the user can simply bring in a second lift unit chassis 102 and quickly connect the second lift unit chassis 102 to the trolley 300. This allows for sharing of patient lift systems 100 between multiple rooms.

To provide a lift unit chassis 102 with such a small size required innovation on the mechanical level as well on the electrical level. The lift unit chassis 102 was designed such that two motors 620 are used to wind the strap 104 upon the spool 702, thereby lifting the patient. The use of the two motors 620 enables the strap 104 and the center of gravity to remain at the center of the lift unit chassis 102. The strap hub 602 is arranged in parallel with the gear shafts 608 of the motors 620. This provides a high efficiency system that is both powerful and compact.

In addition, for maintenance, the lift unit chassis 102 is designed with separate battery compartments. Separate battery compartments the user does not have to disassemble the main covers to replace batteries. In addition, the unit is designed to accept multiple battery technologies such as Li—Po, Ni-Mh, etc., to ensure ease of switching to a different battery type if need ever arises.

The motors 620 also incorporate a spindle lock technology that prevents the motors 620 from back driving and ensures a smooth consistent acceleration and deceleration.

The carry bar 106 is also designed with usability and infection control in mind. A quick connect design allows the user to quickly engage and disengage the carry bar 106 from the strap 104. Passive safety systems in the quick connect carry bar hooks 112A, 112B ensures no accidental disengagement occurs. The user has to lift the carry bar 106 such that the tension is removed between the strap 104 and the carry bar 106 before being able to disconnect the carry bar 106 from the strap 104. Thus, possibility of accidental disengagement is minimized. Seamless design of covers ensure no infection control issues arise from use of the units.

Patient lift systems are primarily used in areas where the patients are too fragile to move themselves and require assistance. This also means that these patients are easily susceptible to infections. Although the patient lift system 100 is designed with infection control in mind, other devices within the room may not have been designed with the same care.

The patient lift system 100 may also include a light wand (not shown) to help with infection control. The light wand may connect to a light wand trolley unit that is received within, and receives electrical power from, the track 108. Alternatively, the light wand may detachably connect to the lift unit chassis 102. Further alternatively, the light wand may employ a built-in connection to the lift unit chassis 102. The light wand may include a light source for generating light in a spectral range that is known to kill bacteria. In use, a user my actuate a switch to illuminate the light source and then cast the light generated by the light source upon exposed surfaces of the patient lift system 100.

Consider that the slot-like aperture in the track 108 may allow bacteria into the track 108. It is proposed herein to minimize exposure of the inside of the track 108 to the ambient environment.

Figure 8B:
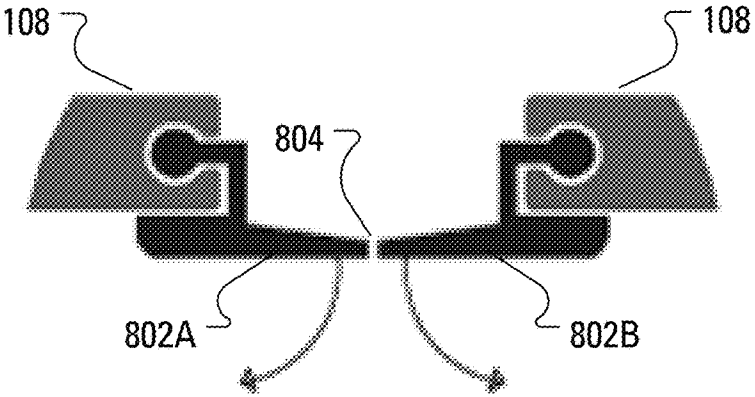
FIG. 8B illustrates, in a sectional view, the modified track of FIG. 8A.
Figure 8A:
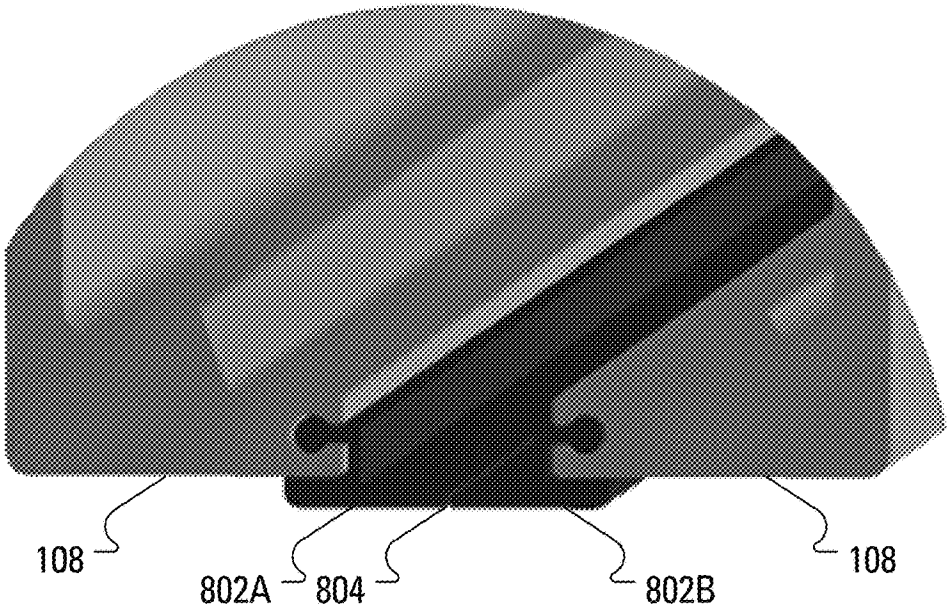
FIG. 8A illustrates, in a perspective view, the track of FIG. 1 modified to include a seal.

FIG. 8A illustrates, in a perspective view, the track 108 of FIG. 1 modified to include a seal made up of two portions: a first seal portion 802A; and a second seal portion 802B. Collectively, the first seal portion 802A and the second seal portion 802B may be called a seal and associated with reference number 802. The seal 802 may be manufactured, for example, from natural rubber or other materials that are known for relative ease in cleaning. Further example materials include Polyurethane, Silicone, Buna-N and a flexible form of Polyvinyl Chloride (PVC). FIG. 8B illustrates, in a sectional view, the modified track of FIG. 8A.

Conveniently, while the opposing portions of the track 108 define a gap of a certain dimension, the seal 802 defines a gap 804 of significantly smaller dimension.

In operation, the seal portions 802A, 802B are arranged to flex to allow the quick release trolley latches 312A, 312B to enlarge and extend through the gap 804 to engage the quick release trolley plate 204 of the lift unit chassis 102. It will be understood that, along the length of the track 108, wherever the quick release trolley latches 312A, 312B are not extending through the gap 804, the gap 804 is maintained at a minimum.

The above-described implementations of the present application are intended to be examples only. Alterations, modifications and variations may be effected to the particular implementations by those skilled in the art without departing from the scope of the application, which is defined by the claims appended hereto.

What is claimed is:

1. A lift unit chassis of a patient lift system, the lift unit chassis comprising:

a lift unit comprising:

a strap hub;

a first lift motor;

a second lift motor;

a transmission, comprising:

a hub transmission component that is connected to the strap hub for rotating the strap hub; and a first motor transmission component that is configured to be driven by the first lift motor;

a second motor transmission component that is configured to be driven by the second lift motor;

wherein:

the hub transmission component, the first motor transmission component, and the second motor transmission component are co-operatively configured such that the hub transmission component is driven in response to driving of the first motor transmission component and the second motor transmission component; and the transmission defines a transmission plane, and the hub transmission component, the first motor transmission component, and the second motor transmission component are disposed on the transmission plane.

2. The lift unit chassis of claim 1, wherein the hub transmission component, the first motor transmission component, and the second motor transmission component are disposed in parallel relative to the transmission plane.

3. The lift unit chassis of claim 1, wherein:

the hub transmission component defines a hub transmission component axis;

the first motor transmission component defines a first motor transmission component axis;

the second motor transmission component defines a second motor transmission component axis; and the hub transmission component axis, the first motor transmission component axis, and the second motor transmission component axis are parallel.

4. The lift unit chassis of claim 1, wherein:

the first lift motor drives a first motor shaft for driving the first motor transmission component;

the second lift motor drives a second motor shaft for driving the second motor transmission component; and the strap hub, the first motor shaft, and the second motor shaft are parallel.

5. The lift unit chassis of claim 1, wherein:

the disposition of the strap hub relative to the lift unit defines a first side and a second side of the lift unit; and the first lift motor is disposed on the first side of the lift unit, and the second lift motor is disposed on the second side of the lift unit.

6. The lift unit chassis of claim 1, wherein the first motor transmission component and the second motor transmission component are disposed on opposite sides of the hub transmission component.

7. The lift unit chassis of claim 1, wherein the transmission comprises:

a first idler transmission component that is interposed between the hub transmission component and the first motor transmission component;

a second idler transmission component that is interposed between the hub transmission component and the second motor transmission component;

wherein:

the first hub transmission component, the first motor transmission component, and the first idler transmission component are co-operatively configured such that the hub transmission component and the first idler transmission component are driven in response to driving of the first motor transmission component;

the second hub transmission component, the second motor transmission component, and the second idler transmission component are co-operatively configured such that the hub transmission component and the second idler transmission component are driven in response to driving of the second motor transmission component; and the first idler transmission component and the second idler transmission component are disposed on the transmission plane.

8. The lift unit chassis of claim 7, wherein the transmission comprises a sequential transmission component train that includes the hub transmission component, the first motor transmission component, the second motor transmission component, the first idler transmission component, and the second idler transmission component.

9. The lift unit chassis of claim 7, wherein the hub transmission component, the first motor transmission component, the second motor transmission component, the first idler transmission component, and the second idler transmission component are gears.

10. The lift unit chassis of claim 1, comprising:

a motor mounting plate and a strap hub mounting plate that are disposed in spaced-apart relationship to define a space therebetween;

wherein:

the first lift motor and the second lift motor are disposed within the space; and the hub transmission component, the first motor transmission component, and the second motor transmission component are disposed outside of the space.

11. The lift unit chassis of claim 1, wherein the strap hub is disposed centrally relative to the lift unit.

12. The lift unit chassis of claim 1, wherein the center of gravity of the lift unit chassis is disposed at the center of the lift unit chassis.

13. The lift unit chassis of claim 1, wherein the first lift motor, the second lift motor, and the strap hub are co-operatively configurable for disposition in a winding configuration and an unwinding configuration, wherein:

in the winding configuration, in response to driving of the strap hub by the first lift motor and the second lift motor, while a strap is connected to the strap hub, the strap is wound on the spool; and in the unwinding configuration, in response to driving of the strap hub by the first lift motor and the second lift motor, while the strap is connected to the strap hub, the strap is unwound from the spool.

14. The lift unit chassis of claim 13, wherein, the first lift motor, the second lift motor, and the strap hub are co operatively configured such that:

while the first lift motor, the second lift motor, and the strap hub are disposed in the winding configuration, the first lift motor and the second lift motor are configured to drive the strap hub to rotate in a first direction; and while the first lift motor, the second lift motor, and the strap hub are disposed in the unwinding configuration, the first lift motor and the second lift motor are configured to drive the strap hub to rotate in a second direction, the second direction opposite the first direction.

15. The patient lift system of claim 1, further comprising:

a first motor lock that is configured to prevent back driving of the first lift motor; and a second motor lock that is configured to prevent back driving of the second lift motor.

16. A lift unit chassis of a patient lift system, the lift unit chassis comprising:

a lift unit comprising:

a strap hub;
a first lift motor;
a second lift motor;
a single plane transmission, comprising:
a hub transmission component that is connected to the strap hub for rotating the strap hub; and
a first motor transmission component that is configured to be driven by the first lift motor;
a second motor transmission component that is configured to be driven by the second lift motor;
a sequential transmission component train that includes the hub transmission component, the first motor transmission component, and the second motor transmission component;
wherein:
the hub transmission component, the first motor transmission component, and the second motor transmission component are co-operatively configured such that the hub transmission component is driven in response to driving of the first motor transmission component and the second motor transmission component;
the sequential transmission component train defines a transmission component plane, and
the hub transmission component, the first motor transmission component, and the second motor transmission component are disposed on the transmission component plane.

17. A lift unit of a patient lift system, the lift unit comprising:
a strap hub;
a first lift motor;
a second lift motor;
a transmission, wherein the strap hub, the first lift motor, the second lift motor, and the transmission are co-operatively configured such that the transmission operatively communicates the strap hub, the first lift motor, and the second lift motor such that the strap hub is drivable by the first lift motor and the second lift motor, the transmission comprising:
a hub transmission component that is connected to the strap hub for rotating the strap hub; and
a first motor transmission component, which is configured to be driven by the first lift motor;
a second motor transmission component, which is configured to be driven by the second lift motor;
wherein:
the hub transmission component, the first motor transmission component, and the second motor transmission component are co-operatively configured such that the hub transmission component is driven in response to driving of the first motor transmission component and the second motor transmission component; and
the hub transmission component, the first motor transmission component, and the second motor transmission component are disposed on a common transmission component plane.

18. A lift unit chassis of a patient lift system, the lift unit chassis comprising:
a lift unit comprising:
a strap hub;
a plurality of lift motors;
a transmission, comprising:
a hub transmission component that is connected to the strap hub for rotating the strap hub; and
a plurality of motor transmission components, wherein each one of the plurality of motor transmission components is, independently, configured to be driven by a corresponding one of the plurality of lift motors;
wherein:
the hub transmission component and the plurality of motor transmission components are co-operatively configured such that the hub transmission component is driven in response to driving of the plurality of motor transmission components; and
the transmission defines a transmission plane, and the hub transmission component and the plurality of motor transmission components are disposed on the transmission plane.

* * * * *